US007877037B2

(12) United States Patent
Igarashi

(10) Patent No.: US 7,877,037 B2
(45) Date of Patent: Jan. 25, 2011

(54) IMAGE FORMING DEVICE HAVING DUCT FOR BLOWING AIR ON CHARGER

(75) Inventor: Hiroshi Igarashi, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 1086 days.

(21) Appl. No.: 11/604,254

(22) Filed: Nov. 27, 2006

(65) Prior Publication Data

US 2007/0146739 A1 Jun. 28, 2007

(30) Foreign Application Priority Data

Dec. 27, 2005 (JP) ..... 2005-375591

(51) Int. Cl.
*G03G 21/20* (2006.01)

(52) U.S. Cl. ..... 399/92

(58) Field of Classification Search ..... 399/92, 399/90, 93, 94, 98, 100
See application file for complete search history.

(56) References Cited

U.S. PATENT DOCUMENTS

| | | | | |
|---|---|---|---|---|
| 3,951,540 | A * | 4/1976 | Ogawa | 399/212 |
| 5,008,716 | A * | 4/1991 | Onose et al. | 399/341 |
| 6,882,809 | B2 | 4/2005 | Hirose et al. | |
| 2003/0185584 | A1 | 10/2003 | Hirose et al. | |
| 2005/0111872 | A1* | 5/2005 | Peffer et al. | 399/92 |
| 2006/0120748 | A1* | 6/2006 | Takehara et al. | 399/92 |

FOREIGN PATENT DOCUMENTS

| | | |
|---|---|---|
| JP | 04-174873 | 6/1992 |
| JP | 05-173377 | 7/1993 |
| JP | 2003-270906 | 9/2003 |
| JP | 2003-287993 | 10/2003 |
| JP | 2003-287996 | 10/2003 |
| JP | 2004-163770 | 6/2004 |
| JP | 2005-215182 | 8/2005 |

OTHER PUBLICATIONS

Office Action for corresponding Japanese Patent Application 2005-375591 mailed on Aug. 3, 2010.
Decision of Rejection in corresponding Japanese Application 2005-375591, mailed Nov. 30, 2010.

* cited by examiner

*Primary Examiner*—Quana M Grainger
(74) *Attorney, Agent, or Firm*—Banner & Witcoff, Ltd

(57) ABSTRACT

An image-forming device includes a main casing, a process casing, a photosensitive member, a charger, a first duct member, a fan, and a duct moving unit. The process casing is accommodated in the main casing and removably mounted thereon. The process casing has a casing inlet formed therein. The photosensitive member is disposed in the process casing. The charger is disposed in the process casing for charging a photosensitive member. The first duct member has a duct outlet. The fan blows air on the charger through the duct outlet of the first duct member and the casing inlet. The duct moving unit moves the first duct member between a first position in which the duct outlet of the first duct member is adjacent to the casing inlet formed in the process casing, and a second position in which the duct outlet is separated farther from the casing inlet than in the first position.

19 Claims, 14 Drawing Sheets

112d
112c
112
111
L1
L3
75
75a
76
112f 112d
112
111
L1
L3
75
75a
76
76b
112f

IMAGE FORMING DEVICE HAVING DUCT FOR BLOWING AIR ON CHARGER

CROSS REFERENCE TO RELATED APPLICATIONS

This application claims priority from Japanese Patent Application No. 2005-375591 filed Dec. 27, 2005. The entire content of priority application is incorporated herein by reference

TECHNICAL FIELD

The present invention relates to an electrophotographic image-forming device.

BACKGROUND

Electrophotographic image-forming devices such as laser printers and photocopiers well known in the art require a charger for applying an electric charge to a photosensitive member. If the charger becomes contaminated with airborne (accumulated) dust particles or other contaminants around the charger, the capacity of the charger for charging the photosensitive member may become insufficient.

The invention in Japanese Patent Application Publication 2003-287996 includes a fan for actively circulating air around the charger. This construction prevents the charger from becoming contaminated by airborne contaminants or contaminants that accumulate around the charger.

SUMMARY

Normally the charger is detachably mounted in the image-forming device and accommodated in a casing of a process cartridge or the like. The casing housing the charger is removed from the image-forming device when the charger needs to be repaired or replaced.

However, since the fan is disposed in the main frame of the image-forming device and not in the casing of the process cartridge or the like housing the charger, a ventilation opening (hereinafter referred to as a "casing inlet") must be provided in the casing of the process cartridge or the like for allowing air to pass through from the main frame side of the image-forming device.

Air blown by the fan is guided into the casing inlet along a duct. With this construction, if a duct outlet formed in a part of the duct facing the casing inlet is in close contact with the casing inlet, then the casing inlet and duct outlet may rub against each other when the casing is mounted and removed, causing damage to both the casing inlet and duct outlet.

On the other hand, if a gap is formed between the casing inlet and the duct outlet to prevent the casing inlet and duct outlet from rubbing against each other when mounting and removing the casing, air blown by the fan can leak through this gap, drastically reducing the efficiency of blowing air on the charger.

In view of the foregoing, it is an object of the present invention to provide an image-forming device capable of preventing the casing inlet and the duct outlet from rubbing against each other, while preventing a dramatic decrease in efficiency at which air is blown on the charger.

To achieve the above and other objects, one aspect of the invention provides an image-forming device including a main casing, a process casing, a photosensitive member, a charger, a first duct member, a fan, and a duct moving unit. The process casing is accommodated in the main casing and removably mounted thereon. The process casing has a casing inlet formed therein. The photosensitive member is disposed in the process casing. The charger is disposed in the process casing for charging a photosensitive member. The first duct member has a duct outlet. The fan blows air on the charger through the duct outlet of the first duct member and the casing inlet. The duct moving unit moves the first duct member between a first position in which the duct outlet of the first duct member is adjacent to the casing inlet formed in the process casing, and a second position in which the duct outlet is separated farther from the casing inlet than in the first position.

DETAILED DESCRIPTION

An aspect in which the electrophotographic image-forming device of the present invention is applied to a color laser printer will be described while referring to the accompanying drawings (First Aspect)

1. General Structure of a Laser Printer

Figure 1:
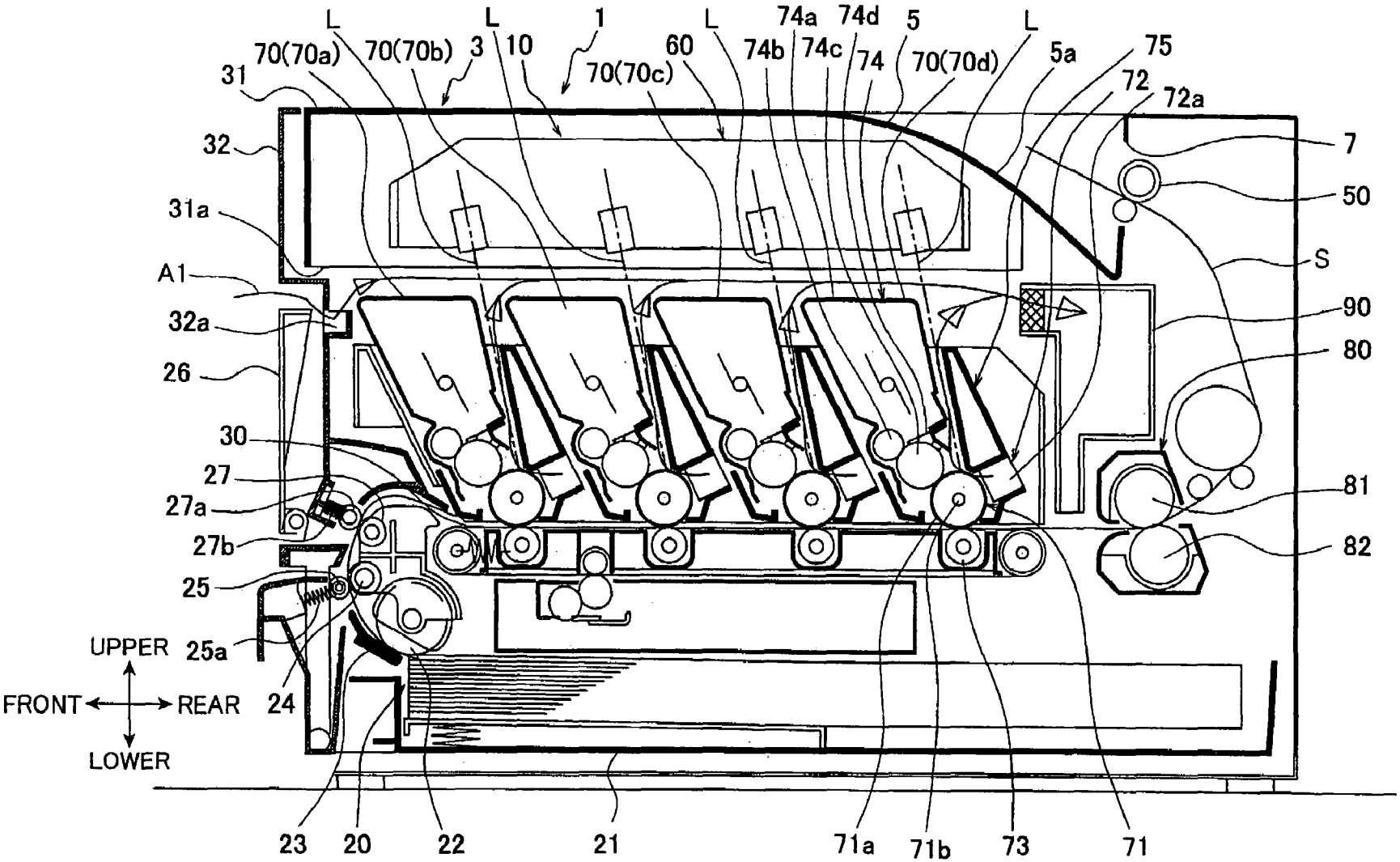
FIG. 1 is a side cross-sectional view showing primary components of a laser printer according to an illustrative aspect of the invention.

FIG. 1 is a side cross-sectional view showing the primary components of a laser printer 1. In the following description, the vertical and front-to-rear directions in FIG. 1 are equated with the vertical and front-to-rear dimensions of the laser printer 1.

The laser printer 1 includes a substantially box-shaped (cube-shaped) main casing 3. A discharge tray 5 is provided on a top surface of the main casing 3 for receiving paper, transparencies, or other recording sheets that are discharged from the main casing 3 after a printing operation.

The discharge tray 5 includes a sloped surface 5*a* sloping down from the top surface of the main casing 3 toward the rear side thereof. A discharge opening 7 is formed in the main casing 3 on the rear side of the sloped surface 5*a* for allowing the recording sheets to be discharged after printing.

The main casing 3 includes a main frame 31 accommodating an image-forming unit 10 and the like described later, and a door 32 provided on the front side of the main frame 31. The door 32 opens and closes to expose and cover an access opening 31*a* formed in the front side of the main frame 31.

A frame member (not shown) formed of metal, synthetic resin, or the like is provided inside the main frame 31 of the main casing 3. Image transfer units 70, a fixing unit 80, and the like described later are detachably mounted in this frame member.

2. Detailed Structure of the Laser Printer

The laser printer 1 also includes the image-forming unit 10, a feeder unit 20, a conveying belt 30, and discharge rollers 50 disposed inside the main casing 3. The image-forming unit 10 forms images on a recording sheet S. The feeder unit 20 supplies the recording sheet S to the image-forming unit 10.

The conveying belt 30 supports and conveys the recording sheet S to four image transfer units 70*a*-70*d* constituting the image-forming unit 10. The discharge rollers 50 discharge the recording sheet S through the discharge opening 7 after the recording sheet S has passed through the image-forming unit 10 (and the fixing unit 80).

2.1 Feeder Unit

The feeder unit 20 includes a paper tray 21 housed in a lowest section of the main casing 3. The paper tray 21 accommodates a plurality of recording sheets S in a stacked state. A feeding roller 22 is disposed above the front end of the paper tray 21 for feeding and conveying the recording sheet S stacked in the paper tray 21 to the image-forming unit 10. A separating pad 23 is disposed in a position opposing the feeding roller 22 for applying a prescribed conveying resistance to the recording sheet S to ensure that the recording sheets are separated and fed one sheet at a time. The feeder unit 20 also includes a manual feed tray 26 rotatably supported by a lower end thereof.

The recording sheet S loaded in the paper tray 21 is fed along a U-shaped path in the front of the main casing 3 and conveyed to the image-forming unit 10. The image-forming unit 10 is positioned substantially in a center of the main casing 3. A conveying roller 24 is disposed in the curved portion of the U-shaped path and applies a conveying force to the recording sheet S for conveying the recording sheet S along the curved path toward the image-forming unit 10.

A pressure roller 25 is disposed at a position opposing the conveying roller 24 for pressing the recording sheet S interposed between the conveying roller 24 and pressure roller 25 against the conveying roller 24. A coil spring 25*a* functions to press the pressure roller 25 (follow roller) toward the conveying roller 24.

A registration roller 27 is disposed downstream of the conveying roller 24 in a sheet conveying direction for correcting skew in a recording sheet S when contacted by the leading edge of the recording sheet S conveyed from the conveying roller 24 and for subsequently conveying the recording sheet S farther toward the image-forming unit 10, A pressure roller (follow roller) 27*a* is disposed in opposition to the registration roller 27. A coil spring 27*b* presses the pressure roller 27*a* against the registration roller 27.

2.2 Image-forming Unit

The image-forming unit 10 includes a scanning unit 60, the image transfer units 70, and the fixing unit 80.

The image-forming unit 10 is a direct tandem-type device capable of printing in color. More specifically, the four image transfer units 70*a*-70*d* are juxtaposed along the conveying direction of the recording sheet S and correspond to the four colors black, cyan, magenta, and yellow.

2.2.1 Scanning Unit

The scanning unit 60 is disposed in the upper section of the main casing 3 and functions to form electrostatic latent images on the surfaces of photosensitive drums 71 provided in the four image transfer units 70*a*-70*d*. More specifically, the scanning unit 60 includes a laser light source, a polygon mirror, fθ lenses, and reflecting mirrors.

The laser light source emits laser beams L based on image data. The laser beams L are deflected by the polygon mirror, pass through fθ lenses, are reflected back in the opposite direction by reflecting mirrors, and finally are reflected by another reflecting mirrors downward toward surfaces of the photosensitive drums 71. The laser beams L irradiate the surfaces of the photosensitive drums 71 to form electrostatic latent images thereon.

2.2.2 Image Transfer Units (Process Cartridges)

Since the image transfer units 70*a*-70*d* have the same construction, differing only in the color of toner accommodated therein, only the structure of the image transfer unit 70*d* is described in the following example. Further, the image transfer units 70*a*-70*d* will be referred to collectively as the image transfer units 70 in the following description.

The image transfer units 70 are disposed below the scanning unit 60 in the main casing 3 and are detachably mounted therein. Each image transfer unit 70 includes the photosensitive drum 71, a charger 72, a transfer roller 73, a developer cartridge 74 and a process casing 75. The process casing 75 houses the photosensitive drum 71, charger 72, and developer cartridge 74.

Since the four image transfer units 70*a*-70*d* are integrally housed in a single process casing 75 in the aspect, the image transfer units 70*a*-70*d* can be mounted in or removed from the main frame 31 altogether by moving the process casing 75 relative to the main frame 31 (main casing 3).

The photosensitive drum 71 is configured of a cylindrical main drum body 71*a* for carrying an image to be transferred onto the recording sheet S, and a drum shaft 71*b* for rotatably supporting the main drum body 71*a*. The outermost layer of the main drum body 71*a* is formed of a positive charging photosensitive layer of polycarbonate or the like. The drum shaft 71*b* extends along the longitudinal direction of the main drum body 71*a* through an axial center thereof.

The charger 72 is disposed diagonally above and rearward of the photosensitive drum 71 and opposes the photosensitive drum 71 at a prescribed distance so as not to contact the same. The charger 72 functions to charge the surface of the photosensitive drum 71.

The charger 72 of the aspect is a Scorotron type charger and includes a casing 72*a* of a square cylindrical shape, and a charging wire formed of tungsten or the like accommodated in the casing 72*a*. The charger 72 produces a corona discharge from the charging wire in order to form a substantially uniform positive charge over the surface of the photosensitive drum 71.

The developer cartridge 74 includes a toner-accommodating chamber 74*a* for accommodating toner, a toner supply roller 74*b* for supplying toner onto the photosensitive drum 71, a developing roller 74*c*, and a thickness-regulating blade 74*d*.

Toner accommodated in the toner-accommodating chamber 74*a* is supplied toward the developing roller 74*c* by the rotating toner supply roller 74*b*. The developing roller 74*c* carries this toner on the surface thereof, while the thickness-regulating blade 74*d* adjusts the amount of toner carried on the surface of the developing roller 74*c* to a uniform layer of prescribed thickness. Subsequently, the toner carried on the surface of the developing roller 74*c* is supplied to the surface of the photosensitive drum 71 in areas exposed by the scanning unit 60.

The transfer roller 73 is disposed in opposition to the photosensitive drum 71 and rotates in association with the rotation of the photosensitive drum 71. By applying a charge of opposite polarity (negative polarity in the aspect) from the charge carried on the photosensitive drum 71 to the surface of the recording sheet opposite the surface being printed as the recording sheet S passes the photosensitive drum 71, toner deposited on the surface of the photosensitive drum 71 is transferred to the printing surface of the recording sheet S.

2.2.3 Fixing Unit

The fixing unit 80 is disposed downstream of the photosensitive drum 71 positioned farthest downstream in the sheet-conveying direction and is detachably mounted in the frame member described above. The fixing unit 80 functions to melt the toner transferred onto the recording sheet with heat in order to fix the toner image to the sheet.

More specifically, the fixing unit 80 includes a heating roller 81 disposed on the printing surface side of the sheet-conveying path, and a pressure roller 82 disposed in opposition to the heating roller 81 on the opposite side of the sheet-conveying path. The heating roller 81 applies a conveying force to the recording sheet S, while heating toner on the surface of the recording sheet S. The pressure roller 82 functions to press the recording sheet S against the heating roller 81.

A motor or other driving unit (not shown) produces a force for driving the heating roller 81. This rotational force is transferred to the pressure roller 82 via the recording sheet S in contact with the heating roller 81 so that the pressure roller 82 follows the rotation of the heating roller 81.

2.2.4 Overview of an Image-forming Operation

The following is a description of how the image-forming unit 10 forms an image on the recording sheet S. As the photosensitive drum 71 rotates, the charger 72 applies a uniform positive polarity to the surface of the photosensitive drum 71. Subsequently, the scanning unit 60 irradiates a laser beam onto the surface of the photosensitive drum 71 in a high-speed scan, thereby forming an electrostatic latent image on the surface of the photosensitive drum 71 corresponding to an image to be formed on the recording sheet.

Next, positively charged toner carried on the surface of the developing roller 74*c* comes into contact with the photosensitive drum 71 as the developing roller 74*c* rotates and is supplied to areas on the surface of the photosensitive drum 71 that were exposed to the laser beam and, therefore, have a lower potential. In this way, the latent image on the photosensitive drum 71 is transformed into a visible image according to a reverse developing process so that a toner image is carried on the surface of the photosensitive drum 71.

Figure 2:
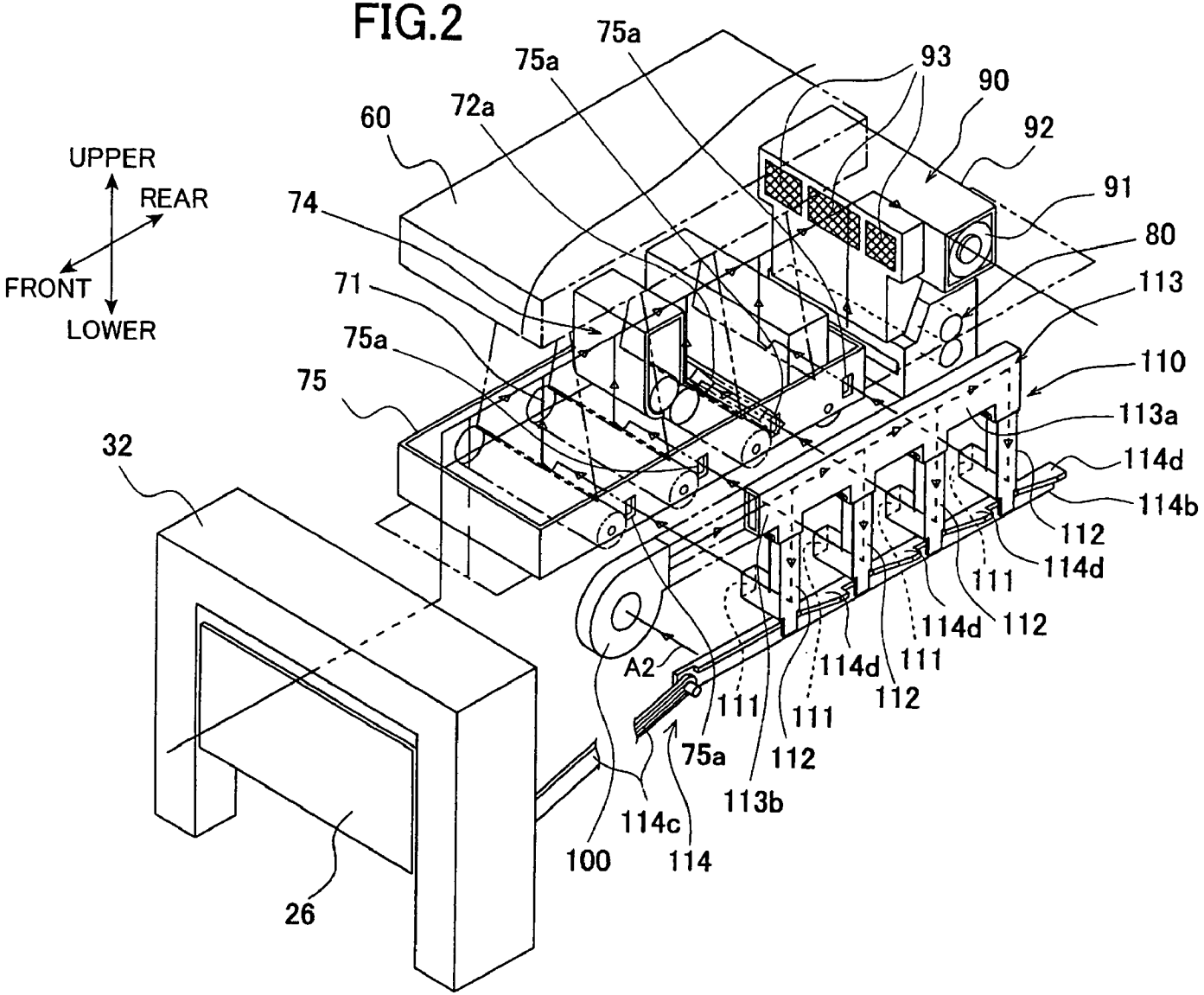
FIG. 2 is an perspective view of a blast path through which air is blown toward a charger in the laser printer of FIG. 1.
Figure 3:
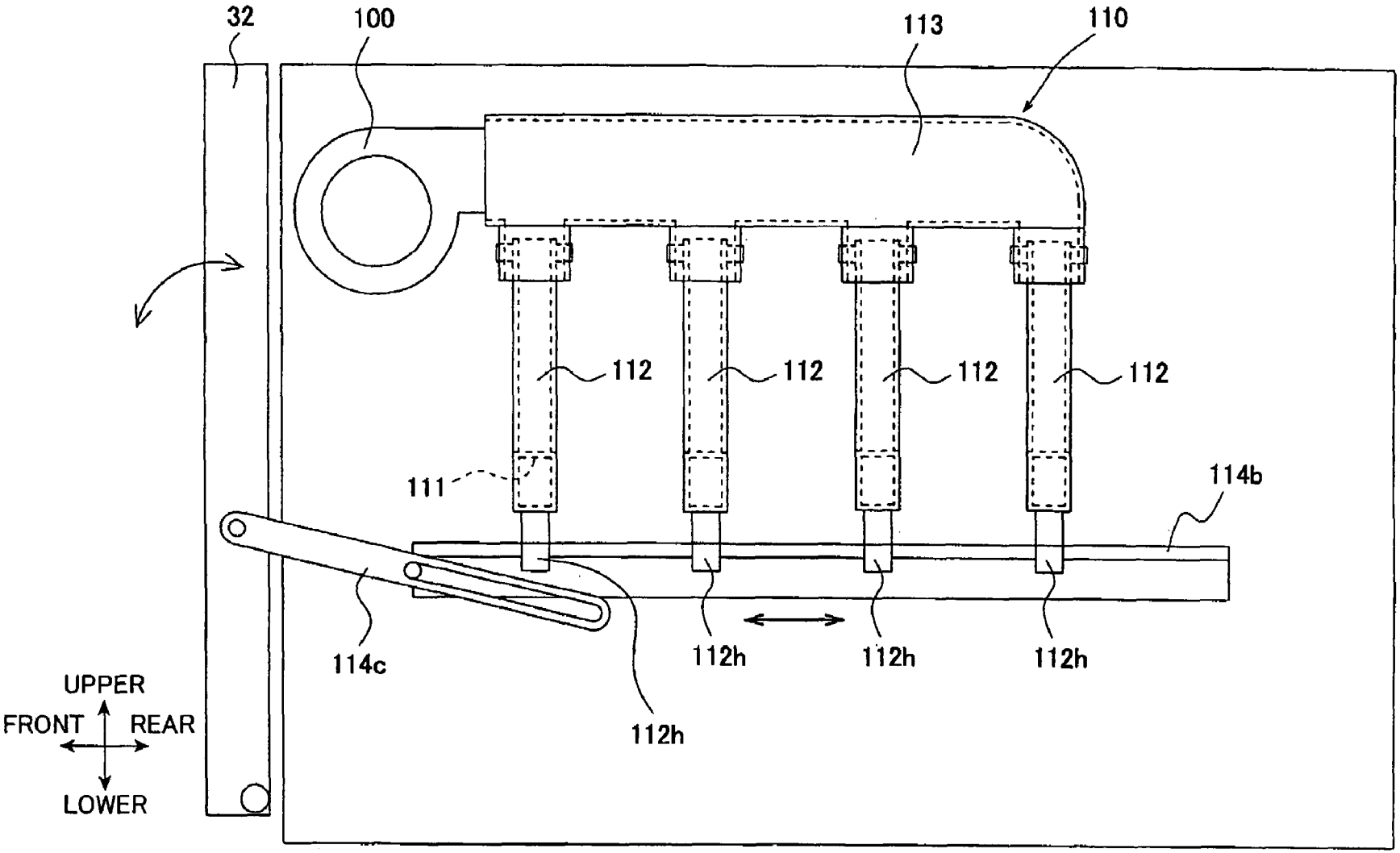
FIG. 3 is a side view of a ventilation duct constituting the blast path according to the illustrative aspect of the invention.
Figure 4:
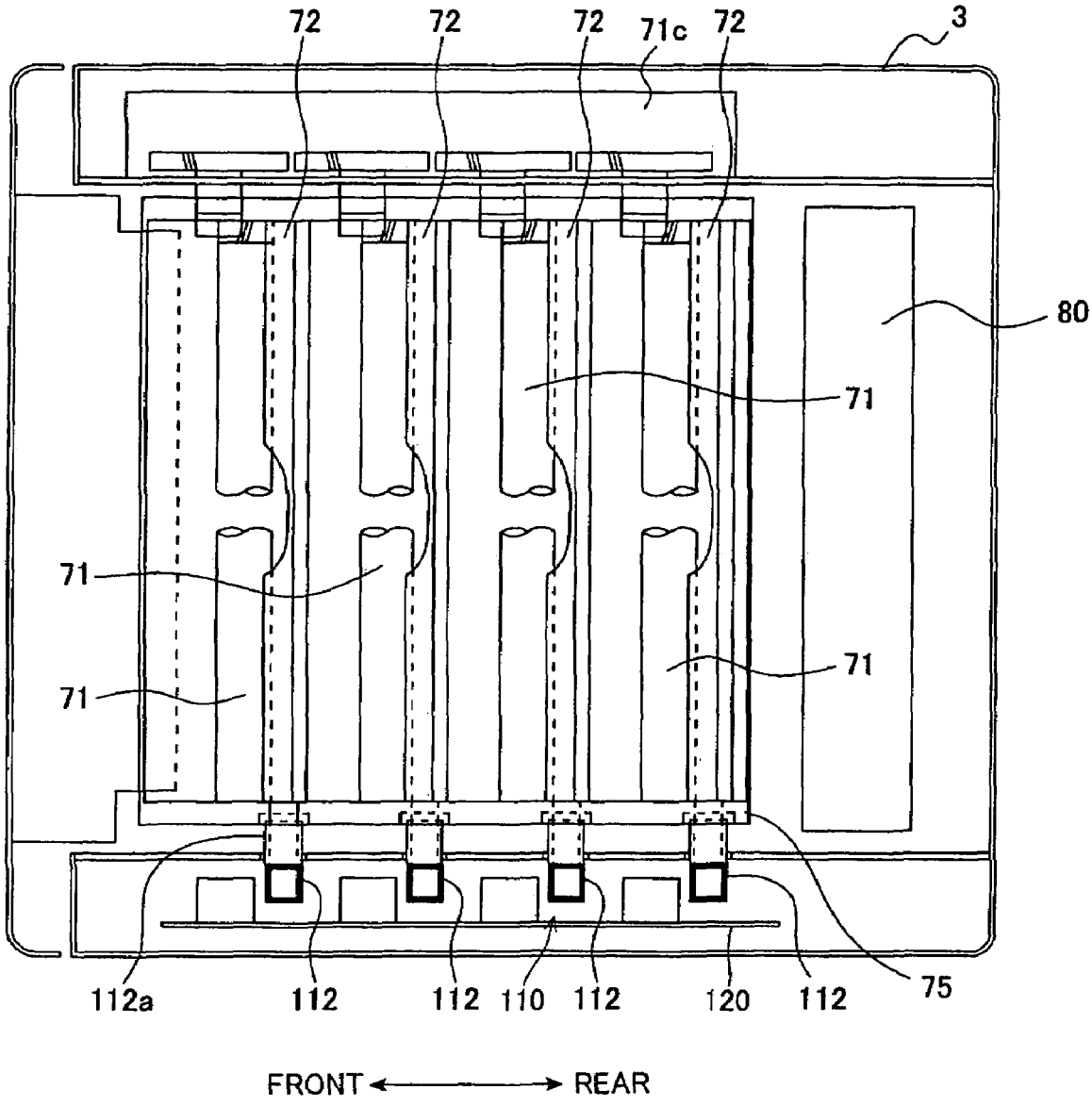
FIG. 4 is a top view of the ventilation duct constituting the ventilation path, a drive mechanism, an electric circuit board, and photosensitive drums according to the illustrative aspect of the invention.
Figure 5B:
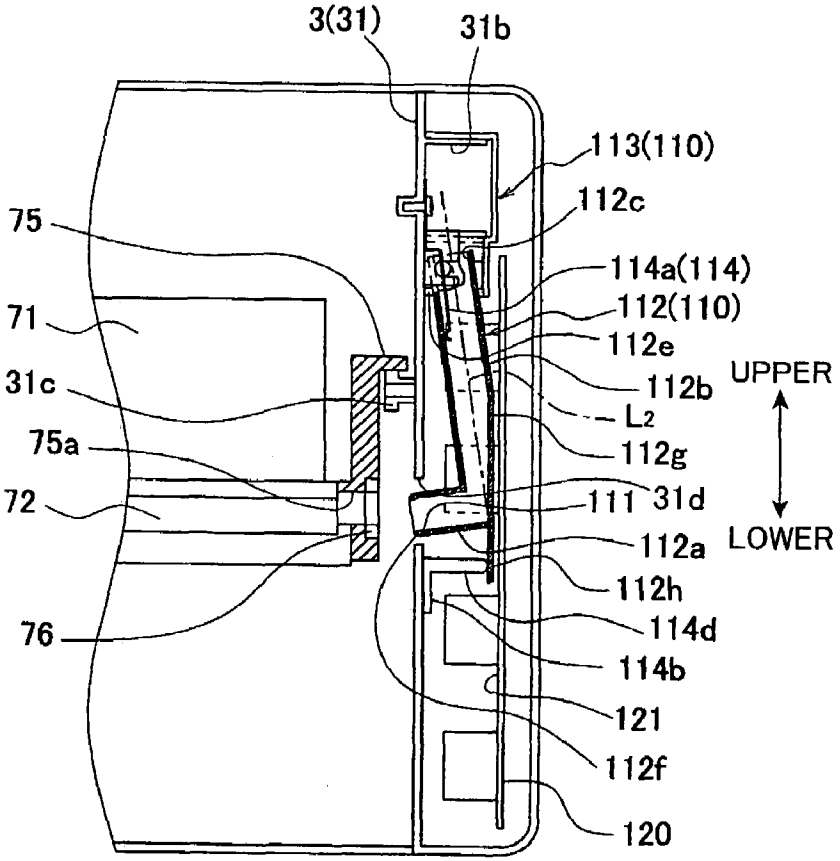
FIG. 5B is a side view illustrating a separated state in which the duct outlet is separated from the casing inlet in the laser printer according to the illustrative aspect of the invention.
Figure 5A:
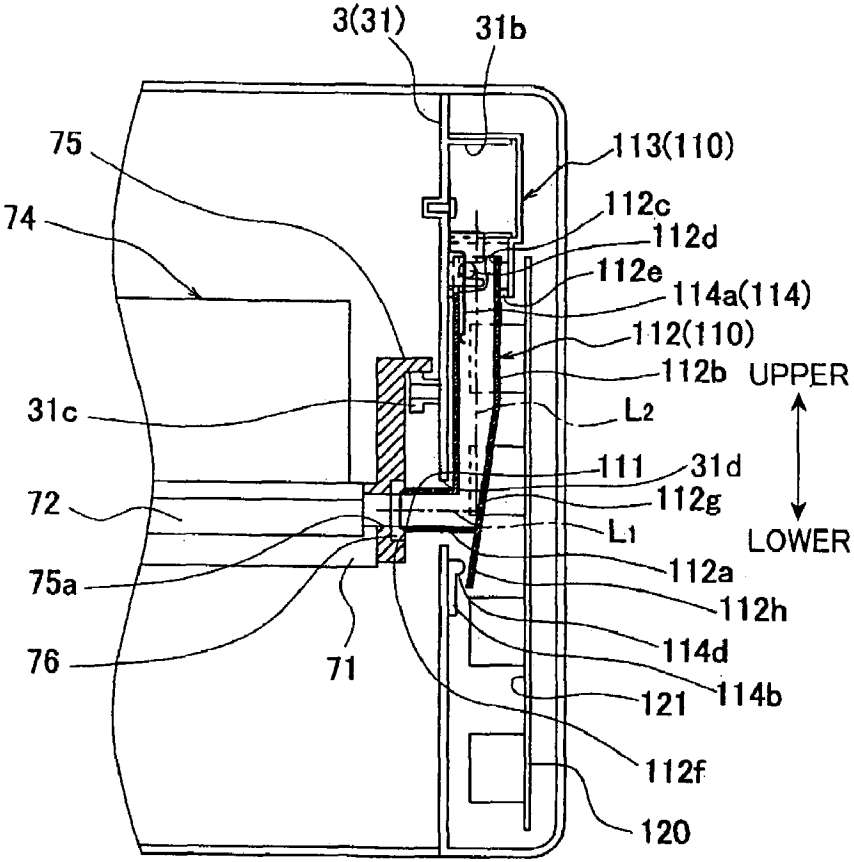
FIG. 5A is a side view illustrating an adjacent state in which a duct outlet is adjacent to a casing inlet formed in a casing in the laser printer according to the illustrative aspect of the invention.
Figure 6:
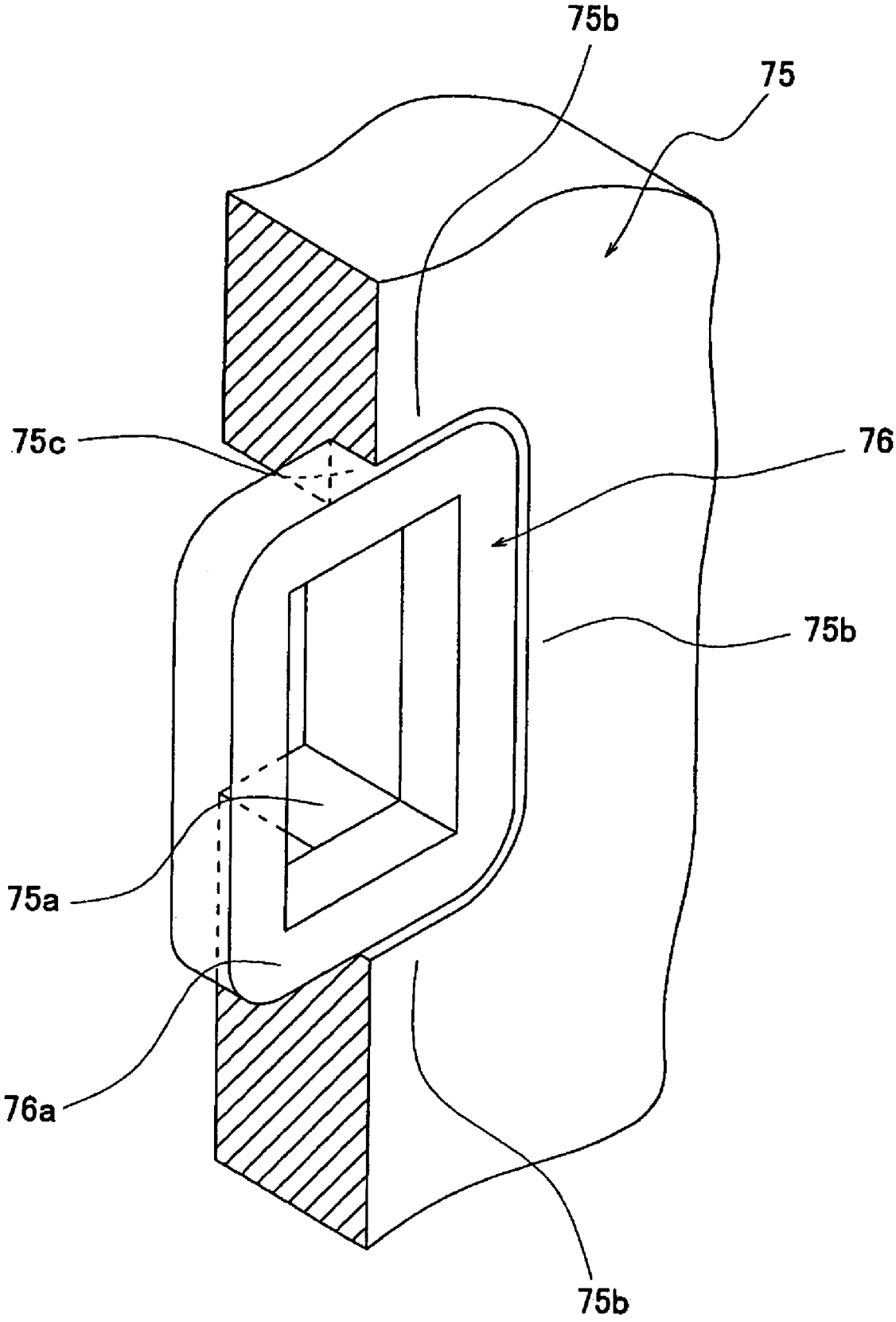
FIG. 6 is an enlarged perspective view of the casing inlet in the laser printer according to the illustrative aspect of the invention.
Figure 7:
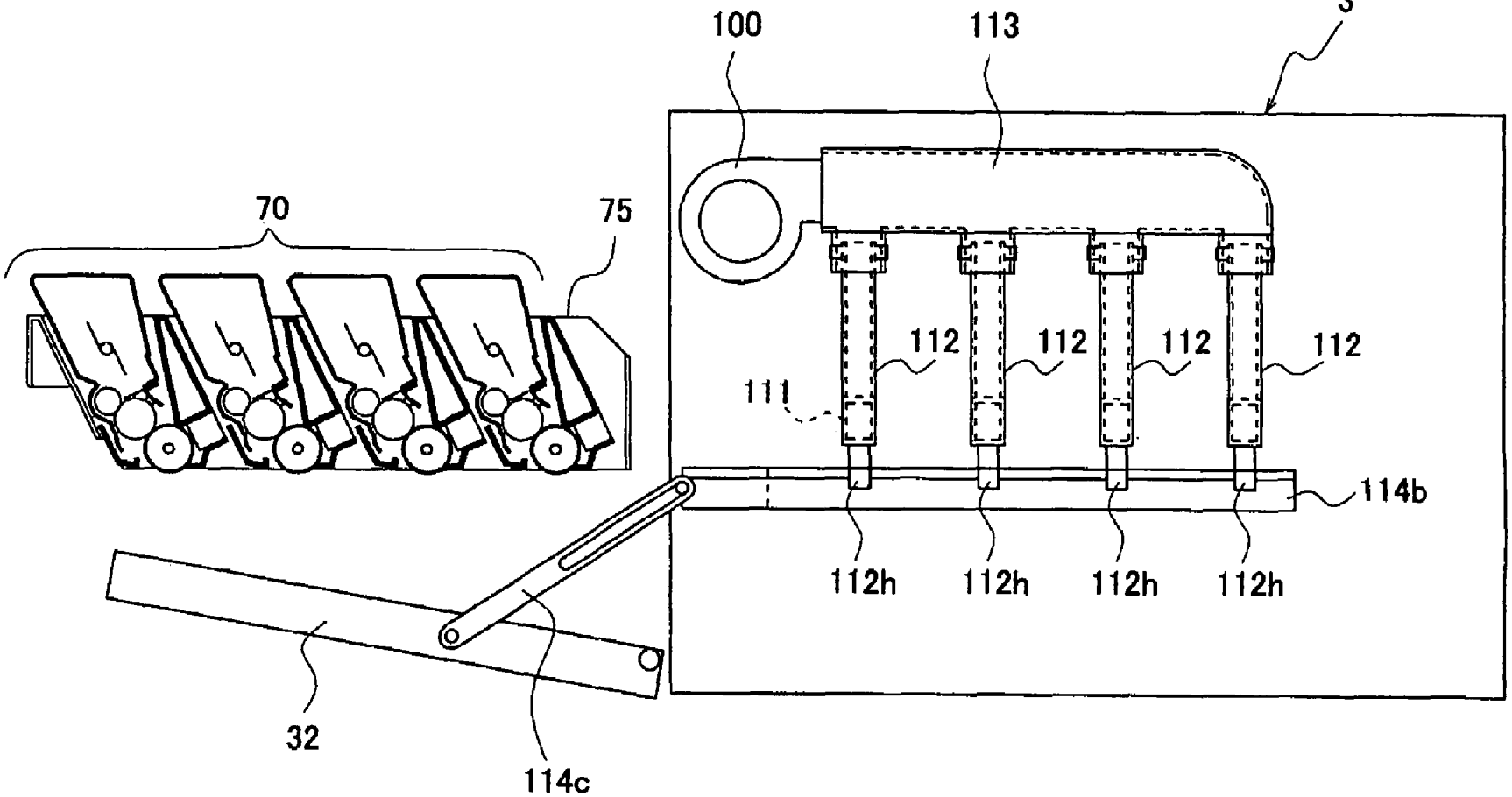
FIG. 7 is a side view of the laser printer illustrating the mounting and removal of the process casing according to the illustrative aspect of the invention.

Subsequently, the toner image carried on the surface of the photosensitive drum 71 is transferred onto the recording sheet S by a transfer bias applied to the transfer roller 73. After the toner image is transferred, the recording sheet S is conveyed to the fixing unit 80. The fixing unit 80 applies heat to the recording sheet S to fix the toner image on the recording sheet S, thereby completing image formation 2.3 Fan System Next, a fan system in the laser printer 1 of the aspect will be described. FIG. 2 is a perspective view of a blast path for air blown toward the charger 72. For clarity, a portion of the image-forming unit 10 has been cut away in FIG. 2. FIG. 3 is a side view of the ventilation duct constituting the blast path. FIG. 4 is a top view of the ventilation duct. FIG. 5 is an explanatory diagram showing operations of a movable duct member 112. FIG. 6 is an enlarged perspective view of a casing inlet 75*a* formed in the process casing 75. FIG. 7 is an explanatory diagram illustrating the mounting and removing operations of the process casing 75.

The laser printer 1 of the aspect has both a cooling fan system and a cleaning fan system. The cooling fan system functions to cool the image-forming unit 10, fixing unit 80, and the like by recovering heat emitted therefrom. The cleaning fan system actively circulates air through the regions around the chargers 72 to reduce the amount of airborne dust particles and other contaminants around the chargers 72.

As shown in FIG. 1, an intake 32*a* is formed in the door 32 at a position corresponding to the top end of the manual feed tray 26. An exhaust unit 90 is disposed in the main casing 3 on the opposite side of the process casing 75 (the fixing unit 80 side) of the intake 32*a*. The exhaust unit 90 draws air A1 into the main casing 3 through the intake 32*a* and discharges the air externally after the air has passed through the main casing 3. This structure constitutes the cooling fan system.

As shown in FIG. 2, the exhaust unit 90 is configured of a collecting duct 92. The collecting duct 92 houses a discharge fan 91 and includes a plurality of exhaust intakes 93 that open toward the inside of the main casing 3. Filters are provided in the exhaust intakes 93 for removing dust and other contaminants.

In the aspect, an axial-flow fan (see JIS B 0132, No. 1012 and the like) is employed as the discharge fan 91. However, it is also possible to use a multiblade centrifugal fan (see JIS B 0132, No. 1004 and the like) such as a turbo fan or sirocco fan, or a cross-flow fan (see JIS B 0132, No. 1017 and the like), for example.

As shown in FIGS. 2 and 3, the cleaning fan system includes a fan 100 for drawing external air through an intake (not shown) in the side surface of the main casing 3 (main frame 31) and blowing the air on the chargers 72, and the ventilation duct 110 for guiding the air blown by the fan 100 toward the chargers 72.

As shown in FIG. 2, casing inlets 75*a* are formed in the process casing 75. The casing inlet 75*a* is coupled to the charger 72 (casing 72*a*) with a duct (not shown). In the aspect, air A2 flowing along the ventilation duct 110 toward the chargers 72 is guided through the casing inlets 75*a* into one longitudinal end of the casings 72*a* and flows through the casings 72*a*.

As shown in FIG. 1, the air is subsequently discharged toward the photosensitive drum 71 through openings (not shown) formed in the casing 72*a*. This discharge of air is substantially uniform along the longitudinal direction of the drum shaft 71*b*. After passing through the openings in the casings 72*a*, the air merges with air in the cooling fan system and is similarly drawn by the exhaust unit 90 and discharged externally.

While a multiblade centrifugal fan is employed in the aspect as the fan 100, an axial-flow fan, a cross-flow fan, or the like may also be used.

2.3.1 Structure of the Ventilation Duct 110

As shown in FIG. 2, the ventilation duct 110 includes movable duct members 112, a fixed duct member 113 fixed to the main casing 3 (main frame 31), and a duct moving mechanism 114 for moving the movable duct members 112. Each of the movable duct members 112 has a duct outlet 111 facing the corresponding casing inlet 75*a*.

2.3.1.1 Movable Duct Members

The movable duct members 112 are molded from electrically insulating material, such as an ABS resin. When the duct outlet 111 formed in the movable duct member 112 is brought near the casing inlet 75*a*, as shown in FIG. 5A, the planes formed in the openings of the duct outlet 111 and casing inlet 75*a* are substantially parallel. Each movable duct member 112 is also configured of a horizontal duct part 112*a* extending parallel to an axis L1 orthogonal to the plane in the opening of the duct outlet 111, and a vertical duct part 112*b* extending orthogonal to the horizontal duct part 112*a*. The main frame 31 is formed with a through-hole 31*d*. The horizontal duct part 112*a* penetrates the though-hole 31*d*.

Each movable duct member 112 also includes an air inlet 112*c* formed in the top end of the vertical duct part 112*b*, and a rotational shaft 112*d* provided near the air inlet 112*c*. The movable duct member 112 is connected to the fixed duct member 113 and capable of pivoting about the rotational shaft 112*d*.

The movable duct member 112 is pivotably connected to the fixed duct member 113 with a portion of the vertical duct part 112*b* inserted (fitted) in the fixed duct member 113. A packing 112*e* formed of an elastic material such as sponge or rubber is provided between an outer peripheral surface of the vertical duct part 112*b* and an inner peripheral surface of the fixed duct member 113.

Therefore, even if the dimension of the gap formed between the outer surface of the vertical duct part 112*b* and the inner surface of the fixed duct member 113 changes as the movable duct member 112 is pivotably moved relative to the fixed duct member 113, the packing 112*e* is capable of elastically changing shape to seal this gap.

A leaf spring 114*a* formed of a steel spring material is disposed inside the movable duct member 112 and fixed duct member 113. The leaf spring 114*a* presses the movable duct member 112 in a direction that moves the duct outlet 111 to be positioned near the casing inlet 75*a*. In the aspect, the duct moving mechanism 114 is configured of the leaf spring 114*a* and an interlocking mechanism described later.

A tapered surface 112*f* is formed around the peripheral surface of the horizontal duct part 112*a* at the end on the duct outlet 111 side. The tapered surface 112*f* slopes relative to the axis L1, reducing the outer dimension of the horizontal duct part 112*a* toward the end thereof.

A recessed part 112*g* is formed in the vertical duct part 112*b* on the opposite side from the process casing 75. The recessed part 112*g* slopes relative to an axis L2 of the vertical duct part 112*b*. The recessed part 112*g* is substantially parallel to a planar surface 121 of an electric circuit board 120 described later when the vertical duct part 112*b* is pivoted toward the side opposite the process casing 75, as shown in FIG. 5B.

The recessed part 112*g* prevents interference between the movable duct member 112 and the electric circuit board 120 disposed on the opposite side of the movable duct member 112 from the process casing 75 when the movable duct member 112 is moved by pivoting.

The planar surface 121 of the electric circuit board 120 is substantially orthogonal to the direction in which the movable duct member 112 is moved (approximately the horizontal direction in the aspect). The electric circuit board 120 supplies power (about 8000 V) to the charger 72.

2.3.1.2 Fixed Duct Member

The fixed duct member 113 is molded of an electrically insulating material such as an ABS resin. As shown in FIGS. 5A and 5B, the portion of the fixed duct member 113 on the process casing 75 side is configured of a duct part 31*b* provided on the main casing 3 (main frame 31).

As shown in FIG. 2, the fixed duct member 113 includes a distribution duct part 113*a* having a square cylindrical shape, and a coupling part 113*b* that couples with the fan 100. The distribution duct part 113*a* extends along the juxtaposed direction of the four image transfer units 70*a*-70*d* for distributing air to each of the movable duct members 112. The fixed duct member 113 is fixed to the main frame 31 via the duct part 31*b*.

2.3.1.3 Duct Moving Mechanism

The duct moving mechanism 114 switches the state of the movable duct members 112 between an adjacent state (or a first position, see FIG. 5A) in which the duct outlets 111 are adjacent to the corresponding casing inlets 75*a*, and a separated state (or a second position, see FIG. 5B) in which the duct outlets 111 are separated farther from the casing inlets 75*a* than in the adjacent state.

The duct moving mechanism 114 is mechanically coupled with the door 32 so as to operate in association with the opening and closing of the door 32. The duct moving mechanism 114 moves the movable duct members 112 adjacent to the process casing 75 when the door 32 is closed and moves the movable duct members 112 away from the process casing 75 when the door 32 is opened.

As shown in FIGS. 2 and 3, the duct moving mechanism 114 includes the leaf spring 114*a* mentioned above, a cam plate 114*b* attached to the main frame 31 in such a way as to be capable of moving in the front-to-rear direction, and a coupling member 114*c* for converting the opening and closing operations of the door 32 to movement of the cam plate 114*b*. The interlocking mechanism is configured of the cam plate 114*b* and the coupling member 114*c*. Through the cooperative operations of the interlocking mechanism and the leaf spring 114*a*, the movable duct members 112 can be switched between the separated state and the adjacent state.

As shown in FIG. 2, triangular-shaped cams 114*d* are provided on the side of the cam plate 114*b* opposite the process casing 75. Each of the cams 114*d* has a sloped surface that gradually moves farther away from the process casing 75 toward the rear side of the main frame 31. The movable duct members 112 contact the cams 114*d* at contact portions 112*h* (FIG. 3). When the door 32 is opened, the cams 114*d* move forward so that the contact portions 112*h* of the movable duct members 112 contact the rear portions of the cams 114*d*.

When the door 32 is closed, the cam plate 114*b* moves rearward so that the contact portions 112*h* contact the front portions of the cams 114*d*.

Hence, when the door 32 is closed, the contact portions 112*h* of the movable duct members 112 move toward the process casing 75, placing the movable duct members 112 in the adjacent state shown in FIG. 5A. When the door 32 is opened, the contact portions 112*h* move toward the side opposite the process casing 75 against an urging force of the leaf spring 114*a*, placing the movable duct members 112 in the separated state shown in FIG. 5B.

2.3.1.4 Process Casing

As shown in FIG. 5A, the process casing 75 is mounted on the main frame 31 by a guiding mechanism 31*c*. The guiding mechanism 31*c* is a guide rail, guide roller, or the like provided on the main frame 31 that enables the process casing 75 to move in the front-to-rear direction (horizontally). As shown in FIG. 7, the process casing 75 and the four image transfer units 70 accommodated in the process casing 75 can be mounted and removed by opening the door 32.

As shown in FIG. 6, packing 76 formed of an elastic material such as a sponge or rubber material is provided in the casing inlets 75*a* of the process casing 75. The packing 76 prevents air from leaking through gaps between the process casing 75 and the horizontal duct parts 112*a* when the movable duct members 112 are in the adjacent state.

More specifically, a recessed part 75*c* is formed in the casing inlet 75*a*. The packing 76 is fitted into the recessed part 75*c* so that an end face 76*a* of the packing 76 on the duct outlet 111 side is positioned farther inside the process casing 75 than a surface 75*b* of the process casing 75 near the peripheral edge of the casing inlet 75*a*, or is in flush with the surface 75*b*.

Hence, the adjacent state of the aspect in which the duct outlets 111 are adjacent to the casing inlets 75*a* indicates a state in which the duct outlets 111 closely contact the packings 76 to prevent air from leaking between the duct outlets 111 and casing inlets 75*a*.

As shown in FIG. 4, the ventilation duct 110 and electric circuit board 120 are disposed on one side of the process casing 75 in the aspect (the lower side in FIG. 4). A drive mechanism 71*c* for driving the photosensitive drums 71 is disposed on the opposite side of the process casing 75 (the top side in FIG. 4).

3. Features of the Laser Printer According to the Aspect

In the aspect, the movable duct member 112 can be switched between an adjacent state in which the duct outlets 111 are adjacent to the casing inlets 75*a* and a separated state in which the duct outlets 111 are separated from the casing inlets 75*a*. Accordingly, it is possible to separate the duct outlets 111 from the casing inlets 75*a* when moving the process casing 75 and placing the duct outlets 111 adjacent to the casing inlets 75*a* when the process casing 75 is fixed in the main frame 31.

By separating the duct outlets 111 from the casing inlets 75*a*, the casing inlets 75*a* do not rub against the duct outlets 111 when moving the process casing 75, thereby preventing damage to the duct outlets 111 and casing inlets 75*a* caused by movement of the process casing 75.

By placing the duct outlets 111 to be positioned near the casing inlets 75*a* when the process casing 75 is fixed in the main frame 31, it is possible to reduce the amount of air that leaks between the duct outlets 111 and casing inlets 75*a*. This construction prevents a considerable decline in efficiency for blowing air on the chargers 72.

As described above, the laser printer 1 of the aspect can prevent a sharp drop in efficiency of blowing air on the chargers 72 and can prevent damage to the duct outlets 111 and casing inlets 75*a* caused by the casing inlets 75*a* rubbing against the duct outlets 111.

Further, the movable duct members 112 are moved in association with the opening and closing operations of the door 32. Closing the door 32 places the movable duct members 112 in the adjacent state, while opening the door 32 places the movable duct members 112 in the separated state. When the door 32 is opened to remove the process casing 75 from the main frame 31, for example, the duct outlets 111 are separated from the casing inlets 75*a* in response to the opening operation of the door 32, thereby facilitating the operation for removing the process casing 75.

When the door 32 is closed after the process casing 75 is mounted in the main frame 31, the duct outlets 111 move adjacent to the casing inlets 75*a* in association with this closing operation, thereby facilitating the mounting operation of the process casing 75.

Further, since the duct moving mechanism 114 moves mechanically in association with the opening and closing operations of the door 32, the movable duct members 112 can be moved in association with the opening and closing of the door 32 using a simple construction that requires no electrical actuators, sensors for detecting the open/closed state of the door 32, and the like. Therefore, the structure of the aspect suppresses an increase in manufacturing costs for the laser printer.

Further, by providing the leaf springs 114*a* for pressing the movable duct members 112 in a direction that brings the duct outlets 111 adjacent to the casing inlets 75*a*, it is possible to reliably place the duct outlets 111 adjacent to the casing inlets 75*a* and press the duct outlets 111 against the casing inlets 75*a*. Accordingly, this construction more reliably reduces the amount of air that leaks between the duct outlets 111 and casing inlets 75*a*.

However, since a high voltage of 8000 V is applied to the charger 72, an insulating member must be provided between the electric circuit board 120 and charger 72 or between the electric circuit board 120 and a power feeding unit (not shown) provided in the charger 72 for supplying power from the electric circuit board 120. The insulating member maintains sufficient clearance distance and creepage distance in order to avoid unnecessary discharge.

In the aspect, the electric circuit board 120 is disposed on the opposite side of the movable duct members 112 from the process casing 75. Since the movable duct members 112 are formed of a synthetic resin, the movable duct members 112 serve as an electrically insulating material disposed between the chargers 72 and electric circuit board 120.

Therefore, an unnecessary insulating member need not be provided between the electric circuit board 120 and chargers 72 or between the electric circuit board 120 and the power feeding unit provided in the chargers 72. By employing the movable duct members 112 formed of an electrically insulating resin material for ensuring sufficient clearance distance and creepage distance between the electric circuit board 120 and chargers 72, measures for avoiding electric discharge can be more easily taken in a limited space.

Since the electric circuit board 120 is substantially plate shaped, the thickness dimension of the electric circuit board 120 orthogonal to the planar surface 121 is smaller than the dimension parallel to the planar surface 121. Therefore, by arranging the electric circuit board 120 so that the planar surface 121 is substantially vertical, as in the aspect, the smallest dimension, that is, the thickness dimension of the electric circuit board 120 is substantially aligned with the direction in which the movable duct members 112 are moved (the horizontal direction). Accordingly, this construction facilitates the allocation of space for moving the movable duct members 112.

Further, this construction does not contribute to an increase in the size of the laser printer 1. The construction also prevents damage to the duct outlets 111 and casing inlets 75*a* caused by the duct outlets 111 rubbing against the casing inlets 75*a*, while preventing a dramatic decline in efficiency for blowing air over the chargers 72.

However, since the electric circuit board 120 is provided near the process casing 75, there is a high probability of problems in allocating space for the leaf springs 114*a* around the process casing 75.

The aspect avoids this problem of allocating space around the process casing 75 for the leaf springs 114*a* by providing the leaf springs 114*a* in the movable duct members 112. Therefore, the leaf springs 114*a* can be easily provided without inviting an increase in the size of the laser printer 1.

Naturally, since the leaf springs 114*a* of the aspect are formed of a steel spring material or other metal having excellent creep property, the leaf springs 114*a* are also electrically conductive. However, since the leaf springs 114*a* are provided inside the movable duct members 112, which are formed of an electrically insulating synthetic resin material in the aspect, this construction prevents the occurrence of unnecessary discharge between the electric circuit board 120 and chargers 72 and the like.

Further, the packing 76 is provided in the casing inlet 75*a* in the aspect for reliably preventing air from leaking between the duct outlets 111 and the casing inlets 75*a*.

Further, the aspect reliably prevents the duct outlet 111 from rubbing against the packing 76 when the process casing 75 moves by configuring the packing 76 so that the end face 76*a* on the duct outlet 111 side is positioned farther inside or is in flush with the surface 75*b* around the outer periphery of the casing inlet 75*a*. Accordingly, this structure prevents damage to the packing 76 when the process casing 75 moves.

By configuring the ventilation duct 110 of the movable duct members 112 and the fixed duct member 113 in the aspect, the movable duct members 112 can be made smaller than when the entire ventilation path from the fan 100 to the duct outlets 111 is configured of the movable duct members 112. Therefore, the movable duct members 112 can be easily moved using less force.

Further, by forming part of the fixed duct member 113 in the aspect with the duct part 31*b* of the main frame 31, it is possible to reduce the number of parts required to form the ventilation duct 110, thereby reducing the manufacturing costs of the laser printer 1.

In the aspect, the movable duct members 112 are moved by swinging about the air inlet 112*c* end. Accordingly, the range of motion of the movable duct member 112 is less than when the entire movable duct member 112 is moved in a translatory motion, thereby avoiding a need to increase the size of the laser printer 1.

FIGS. 8A-8D are side cross-sectional views illustrating the swinging state of the movable duct member 112. These drawings also show the structures of the casing inlet 75*a* and the duct outlet 111 in greater detail. As shown in FIGS. 8A-8D, the movable duct member 112 is swingingly moved about the air inlet 112*c* end. Accordingly, when the movable duct member 112 is nearest the casing inlet 75*a* (including a state of contact), there is a high possibility that the end face of the duct outlet 111 is not parallel to the end face of the casing inlet 75*a* and that the axis L1 orthogonal to the end face of the duct outlet 111 is not aligned with an axis L3 orthogonal to the end face of the casing inlet 75*a*. In other words, there is a danger that the duct outlet 111 and the casing inlet 75*a* will not reliably fit together.

However, the movable duct member 112 of the aspect has the tapered surface 112*f* formed on the duct outlet 111 end for guiding the duct outlet 111 end of the movable duct member 112 into the casing inlet 75*a*.

Figures 8A, 8B, 8C, 8D:
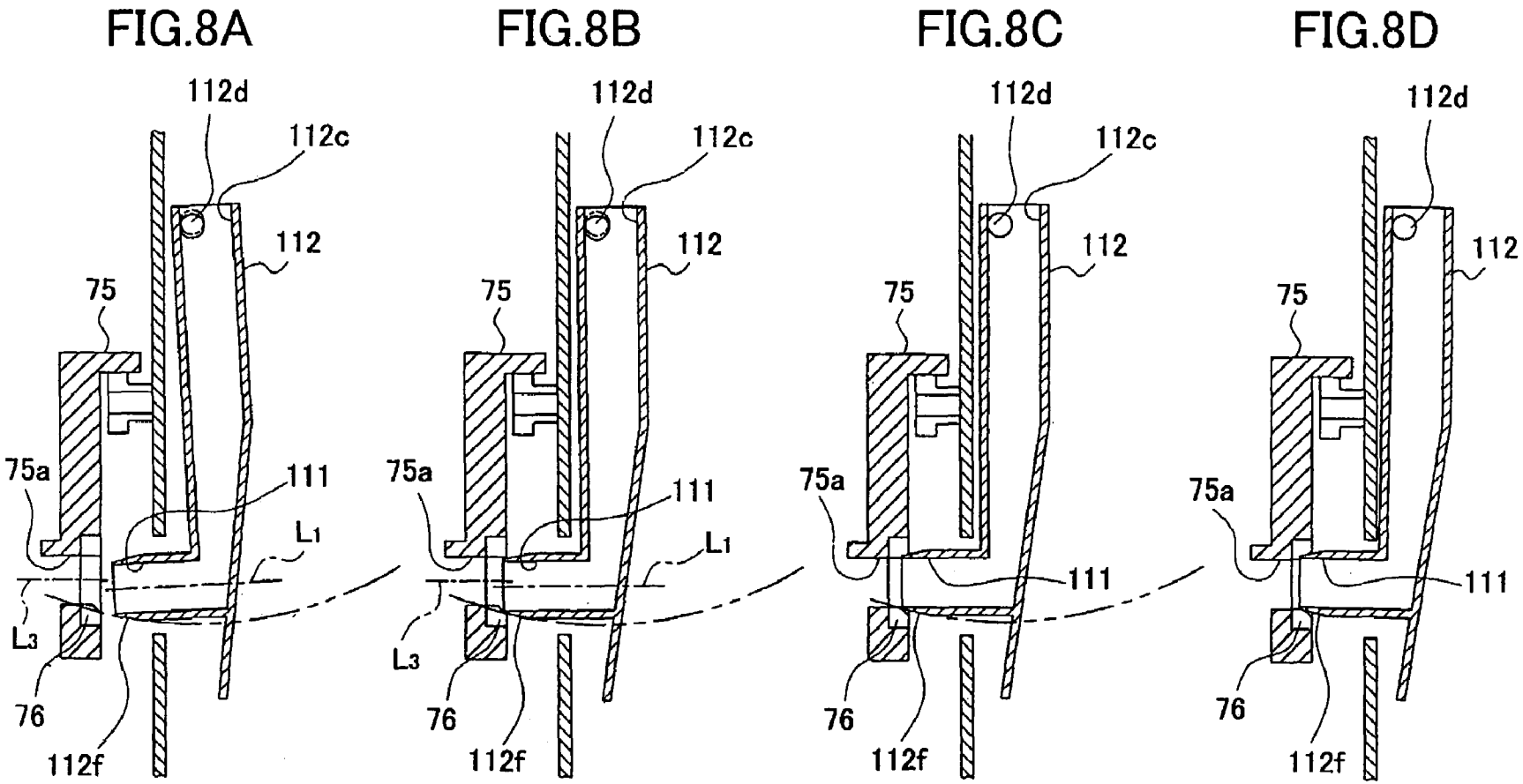
FIGS. 8A-8D are cross-sectional views illustrating the pivoted state of a movable duct member in the laser printer according to the illustrative aspect of the invention.

For example, if the actual pivoting center of the movable duct member 112 (the rotational shaft 112*d* illustrated by a solid line in the drawings) is shifted lower than the designed pivoting center (the rotational shaft 112*d* illustrated by a dotted line), as shown in FIG. 8A, then the axis L1 of the duct outlet 111 will be offset from the axis L3 of the casing inlet 75*a* when the duct outlet 111 approaches the casing inlet 75*a*, as shown in FIG. 8B. Hence, the duct outlet 111 and casing inlet 75*a* do not reliably fit together.

However, since the movable duct member 112 is provided with the tapered surface 112*f* in the aspect, the actual pivoting center of the movable duct member 112 is corrected as the duct outlet 111 is fitted into the casing inlet 75*a* and is aligned with the designed pivoting center, as shown in FIGS. 8C and 8D.

Therefore, the duct outlet 111 can be reliably fitted into the casing inlet 75*a*, even when the end face of the duct outlet 111 is not parallel to the end face of the casing inlet 75*a* and when the axis L1 of the duct outlet 111 is offset from the axis L3 of the casing inlet 75*a*.

Further, providing the recessed part 112*g* on the vertical duct part 112*b* of the aspect allows the duct outlet 111 to be separated far enough from the casing inlet 75*a*, without increasing the area for moving the movable duct member 112. Hence, this construction reliably prevents damage to the duct outlet 111 and casing inlet 75*a*, without leading to an increase in the size of the laser printer 1.

Further, by providing the movable duct members 112 on one side of the process casing 75 and the drive mechanism 71*c* on the other side in the aspect, space can be more easily allocated for the movable duct members 112 than when providing the drive mechanism 71*c* and movable duct members 112 on the same side of the process casing 75.

The image-forming device of the present invention is not limited to the aspect described above Many modifications and variations may be made therein without departing from the spirit of the invention, the scope of which is defined by the attached claims. For example, the duct moving mechanism 114 in the aspect described above may be replaced with a duct moving mechanism 214 shown in FIGS. 9A-9C. As shown in the drawings, the duct moving mechanism 214 is disposed on the opposite side of the movable duct members 112 from the process casing 75. The duct moving mechanism 214 includes a leaf spring 214*a*, a cam plate 214*b* mounted on the main frame 31 so as to be capable of moving in the front-to-rear direction, and a coupling member 214*c* for converting the opening and closing operations of the door 32 to movement of the cam plate 214*b*. An interlocking mechanism is configured of the cam plate 214*b* and coupling member 214*c*. Through the cooperative actions of the interlocking mechanism and the leaf spring 214*a*, the movable duct member 112 can be switched between a separated state and an adjacent state.

Figure 9A:
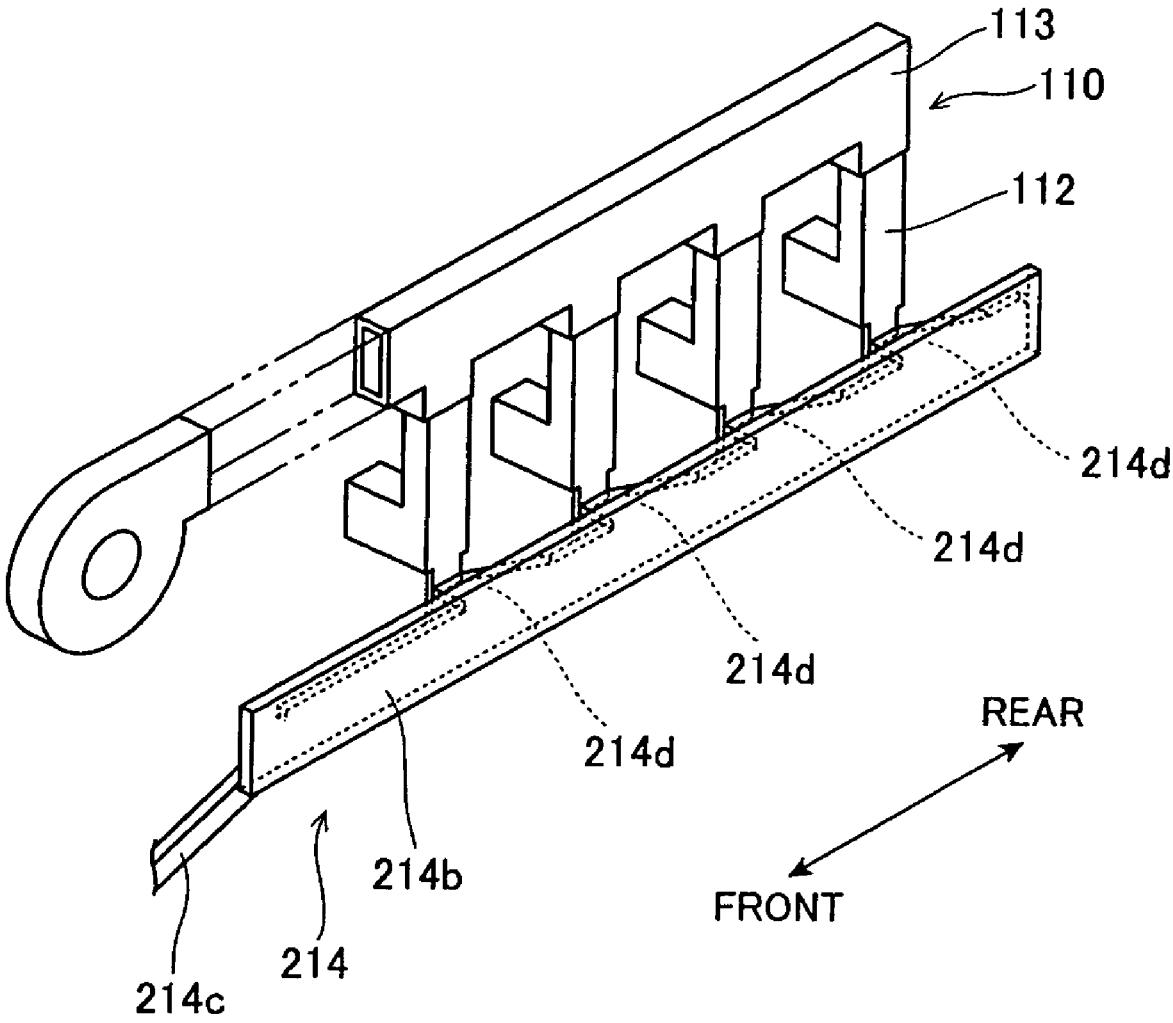
FIG. 9A is a perspective view showing a variation of a duct moving mechanism in the laser printer according to the illustrative aspect of the invention.
Figure 9C:
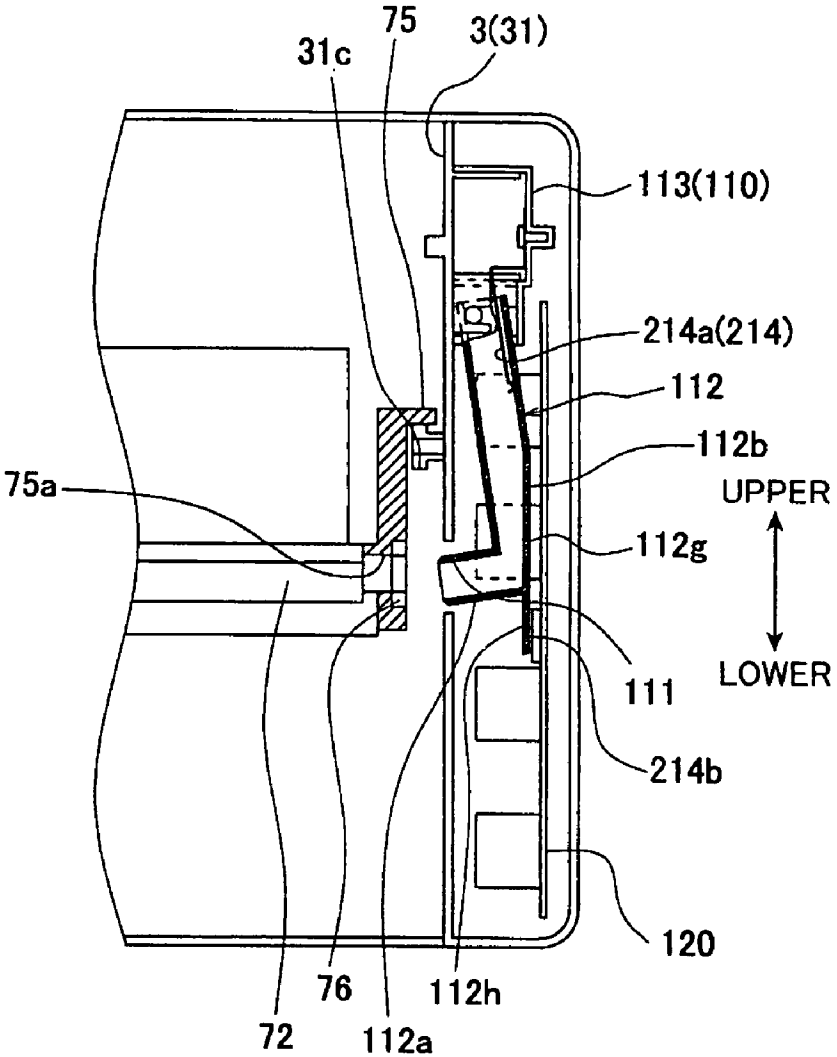
FIG. 9C is a side view illustrating the separated state in which the duct outlet is separated from the casing inlet when using the duct moving mechanism of FIG. 9A.
Figure 9B:
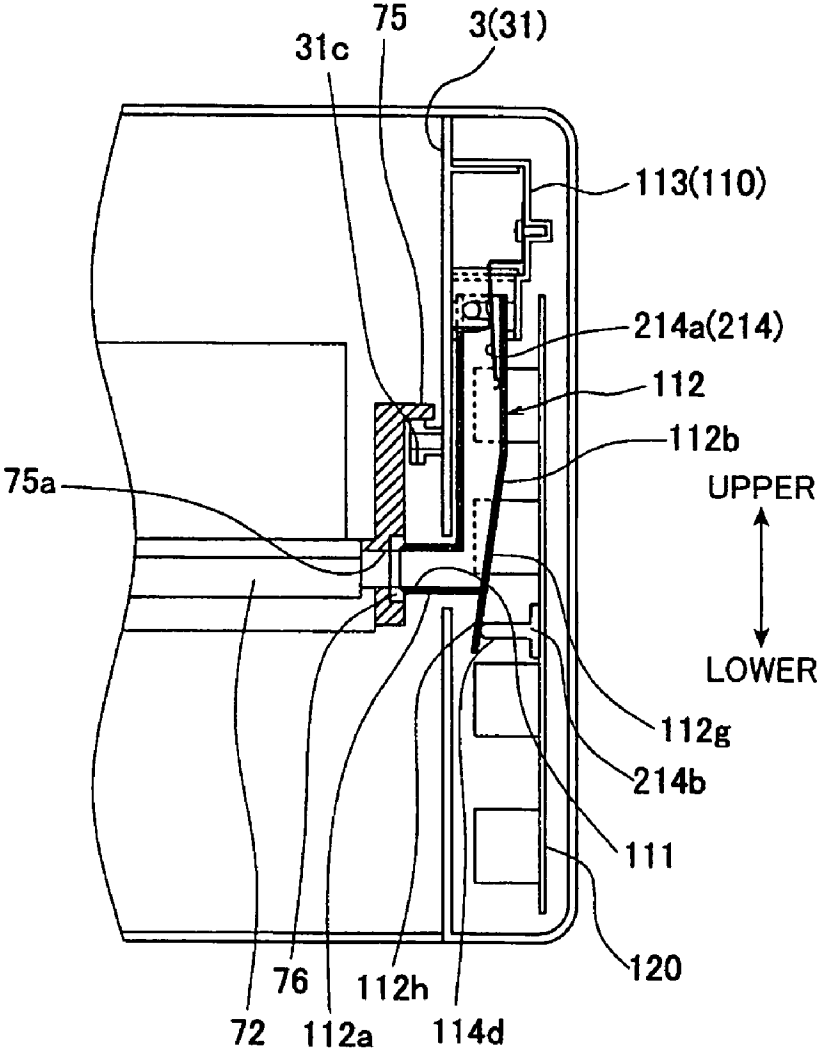
FIG. 9B is a side view showing the adjacent state in which the duct outlet is adjacent to the casing inlet when using the duct moving mechanism of FIG. 9A.

In the aspect, the leaf spring 214*a* is formed of a steel member that is disposed inside the movable duct member 112 and the fixed duct member 113, as shown in FIG. 9B. The leaf spring 214*a* urges the movable duct member 112 in a direction that moves the duct outlet 111 away from the casing inlet 75*a*.

As shown in FIG. 9A, triangular-shaped cams 214*d* are provided on the process casing 75 side of the cam plate 214*b*.

The cams 214*d* have sloped surfaces that slope gradually closer to the process casing 75 toward the front side of the main frame 31. When the door 32 is opened, the cam plate 214*b* moves forward so that the contact portions 112*h* of the movable duct members 112 contact the cam plate 214*b*, as shown in FIG. 9C. When the door 32 is closed, the cam plate 214*b* moves rearward so that the front portion of the cams 214*d* contact the contact portions 112*h*, as shown in FIG. 9B.

Accordingly, closing the door 32 moves the contact portions 112*h* of the movable duct members 112 toward the process casing 75, placing the movable duct members 112 in the adjacent state shown in FIG. 9B. On the other hand, opening the door 32 moves the contact portions 112*h* of the movable duct members 112 away from the process casing 75 so that the movable duct members 112 are in the separated state shown in FIG. 9C.

Figure 10:
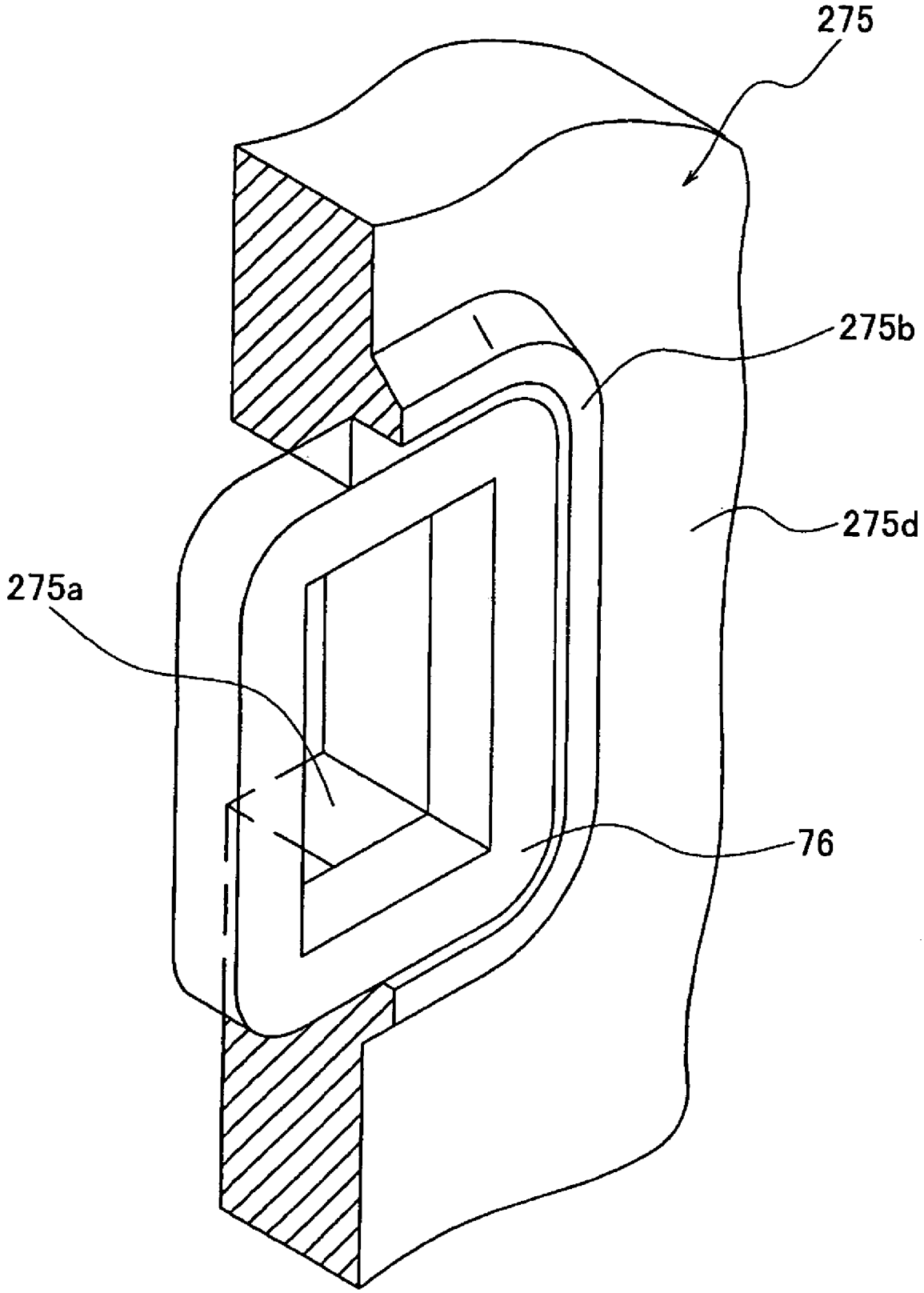
FIG. 10 is a perspective view showing a variation of the process casing in the laser printer near the casing inlet.
Figure 11:
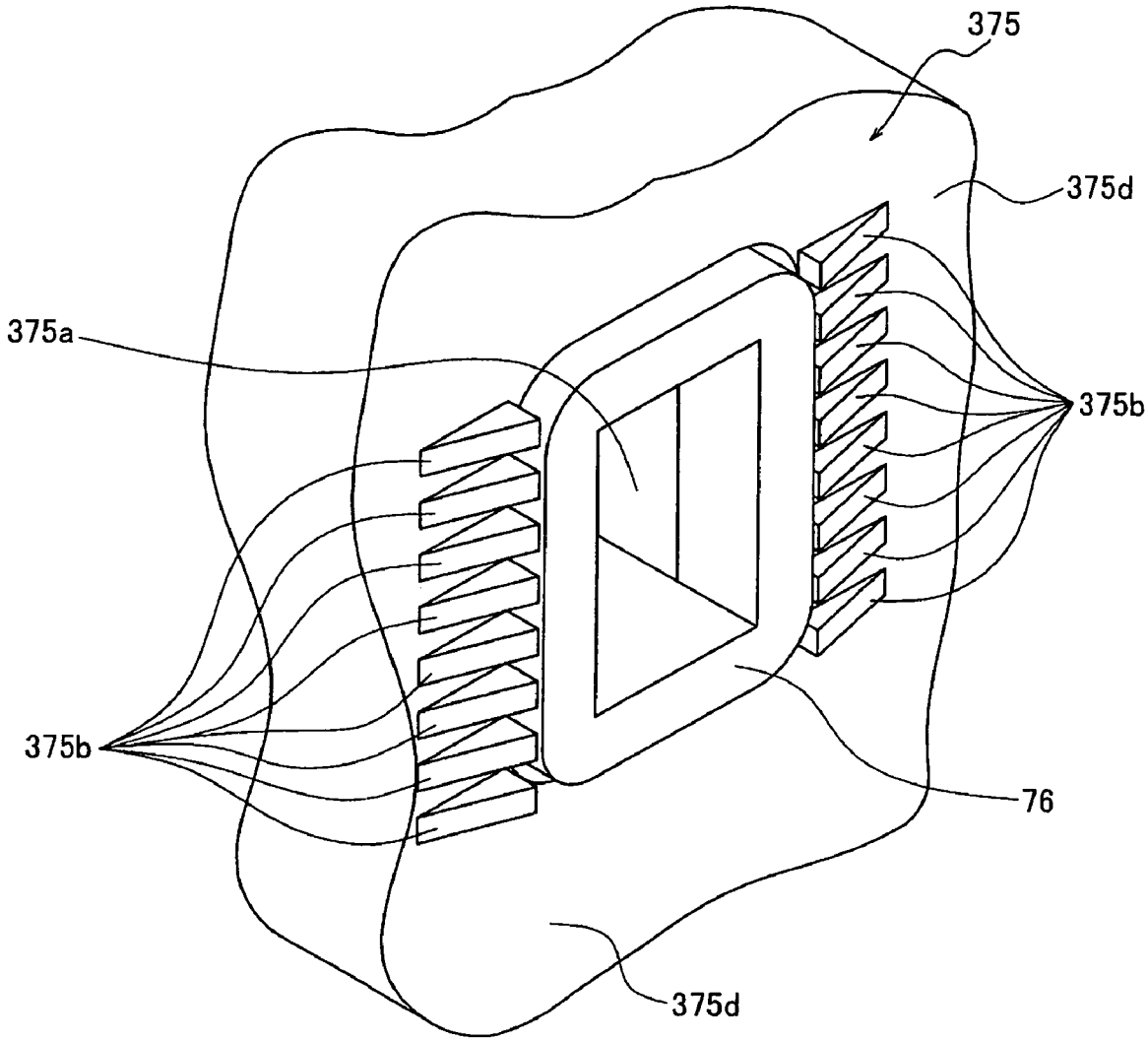
FIG. 11 is a perspective view showing another variation of the process casing in the laser printer near the casing inlet.

The surface 75*b* near the peripheral edge of the casing inlet 75*a* is a flat surface in flush with regions on the surface of the process casing 75 farther away from the peripheral edge in the aspect described above. However, process casings 275 and 375 shown in FIGS. 10 and 11 are also possible. As shown in FIGS. 10 and 11, surfaces 275*b* and 375*b* near the peripheral edge of casing inlets 275*a* and 375*a* protrude farther toward the movable duct member 112 than regions 275*d* and 375*d* of the surface farther away from the peripheral edges of the casing inlets 275*a* and 375*a*, respectively.

As in the aspect described above, the packing 76 is provided in each of the casing inlets 275*a* and 375*a* at a position farther inside the process casings 275 and 375 than the surfaces 275*b* and 375*b*, respectively, or is in flush with the surfaces 275*b* and 375*b*.

Figure 12B:
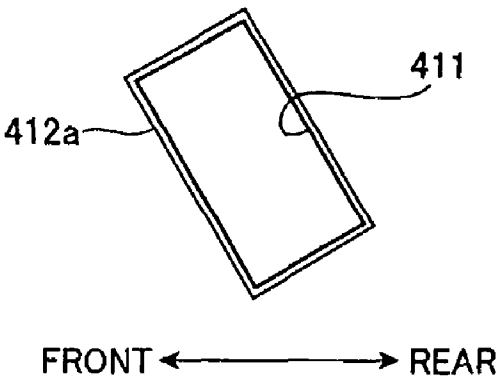
FIG. 12B is a cross-sectional view showing a variation of a duct outlet of a horizontal duct part in the laser printer according to the illustrative aspect of the invention.
Figure 12A:
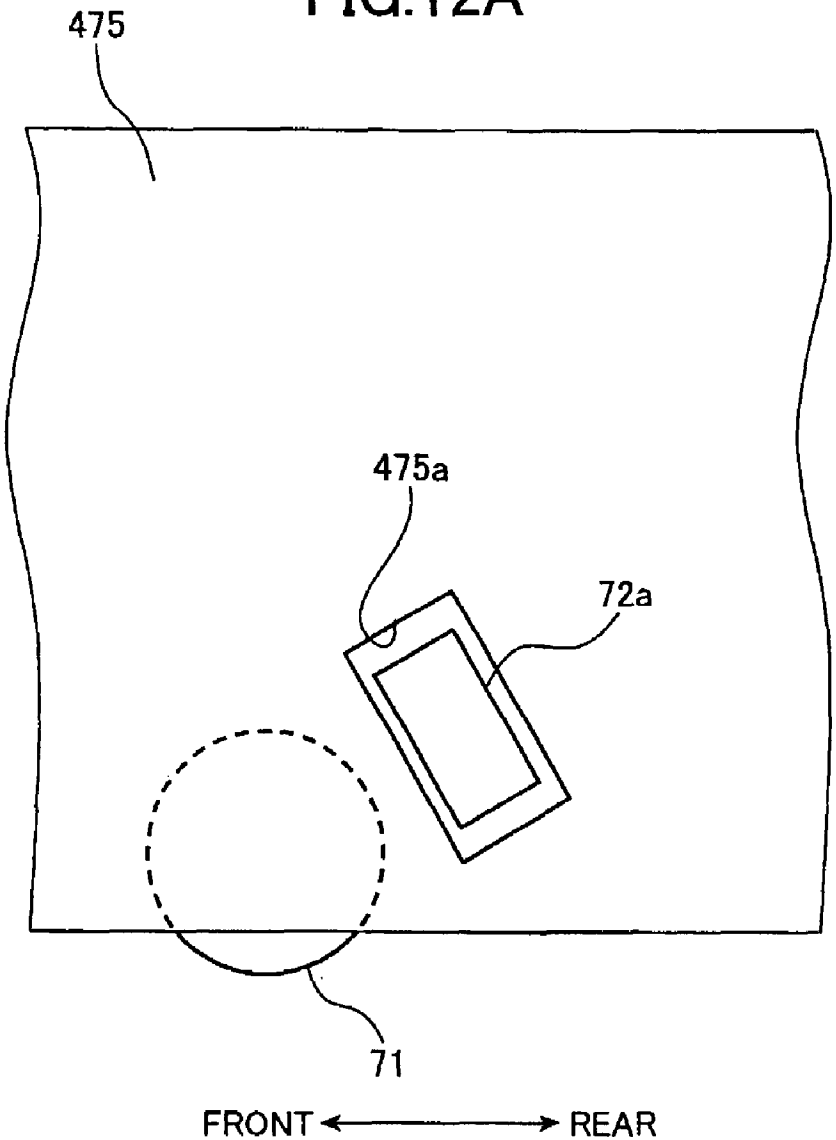
FIG. 12A is an explanatory diagram showing a variation of a casing inlet in a process casing of the laser printer according to the illustrative aspect of the invention.
Figures 13A, 13B, 13C, 13D:
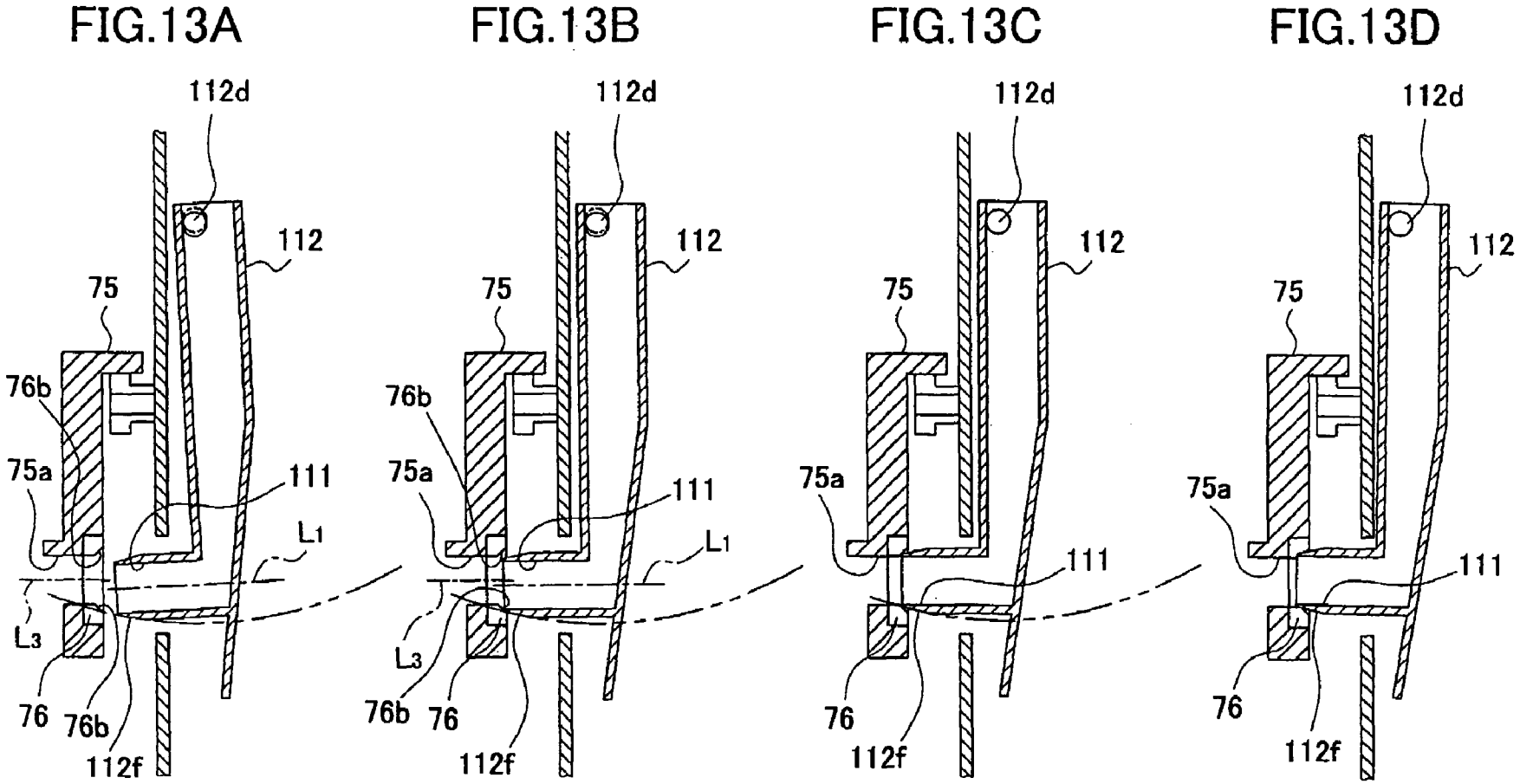
FIGS. 13A-13D are cross-sectional views showing a variation of a packing in the laser printer.

In the aspect described above, the casing inlet 75*a* is formed so that the longitudinal dimension is substantially vertical, and the casing inlet 75*a* is coupled to the charger 72 (casing 72*a*) with the duct (not shown). However, as in a process casing 475 shown in FIG. 12A, a casing inlet 475*a* may be formed in the process casing 475 so that the longitudinal dimension slopes to conform with the slope of the casing 72*a* and so that the longitudinal dimension is greater than the vertical cross section of the casing 72*a*. As shown in FIG. 12B, a duct outlet 411 of a horizontal duct part 412*a* corresponding to the duct outlet 111 of the horizontal duct part 112*a* in the above aspect may be formed at a size and slope corresponding to the size and slope of the casing inlet 475*a* so as to be capable of fitting into the casing inlet 475*a*.

This construction eliminates the duct required to couple the casing inlet 75*a* to the casing 72*a* of the charger 72 and enables air circulating through the duct outlet 411 and casing inlet 475*a* to be efficiently supplied into the casing 72*a*.

It is also possible to form a sloped part 76*b* on the packing 76 for guiding the duct outlet 111, as shown in FIGS. 13A-13D.

By providing the sloped part 76*b* for guiding the duct outlet 111, it is possible to ensure a closer fit between the packing 76 and duct outlet 111. Hence, this construction can further suppress the leakage of air between the packing 76 and duct outlet 111.

While the movable duct member 112 is pivotably moved in the aspect described above, the present invention is not limited to this type of movement. For example, the movable duct member 112 may also be shifted in a translatory motion.

Further, while the movable duct members 112 are moved mechanically in association with the opening and closing of the door 32 in the aspect described above, the present invention is not limited to this movement. For example, movement of the movable duct members 112 may be controlled electrically using a sensor for detecting the open/closed state of the door 32 and an electrical actuator.

In the aspect described above, the cams 114*d* are configured to move all four movable duct members 112 simultaneously. However, the cams 114*d* may be configured to move the movable duct members 112 in sequence one at a time, for example. Such a construction can reduce the operating force required by the cam plates 114*b* (door 32).

Further, while the movable duct members 112 move in association with the opening and closing operations of the door 32 in the aspect described above, the present invention is not limited to this construction.

In the aspect described above, the process casing 75 accommodates other components in addition to the chargers 72, but the present invention is not limited to this structure.

While the aspect described above is provided with the leaf springs 114*a* or other urging unit, the present invention may be applied to a structure that omits this urging unit. Further, while the leaf springs 114*a* disposed in the movable duct members 112 in the aspect described above, the leaf springs 114*a* may also be disposed outside of the movable duct members 112.

While the movable duct members 112 in the aspect described above are formed of a synthetic resin material, the present invention is not limited to this structure.

The electric circuit board 120 in the aspect described above is arranged so that the planar surface 121 is vertical, but the present invention is not limited to this arrangement.

Further, while the electric circuit board 120 of the aspect described above supplies electricity to the chargers 72, the present invention is not limited to this construction.

In the aspect described above, the packing 76 is arranged in each of the casing inlets 75*a*. However, the present invention may be applied to structures in which the packing 76 is arranged in each of the duct outlets 111 or omitted altogether.

While the drive mechanism 71*c* is disposed on the opposite side of the process casing 75 from the movable duct members 112 in the aspect described above, the drive mechanism 71*c* and movable duct members 112 may be provided on the same side of the process casing 75.

In the aspect described above, the duct outlets 111 are configured to fit inside the casing inlets 75*a*. However, the present invention may apply to other adjacent states, such as a state in which the casing inlets 75*a* and duct outlets 111 butt against one another or a state in which the casing inlets 75*a* protrude toward and fit into the duct outlets 111.

For the adjacent state in which the casing inlets 75*a* are fitted into the duct outlets 111, it is possible to form the tapered surface 112*f* on the inner peripheral surface of the movable duct member 112 at the duct outlet 111 end or to provide a tapered surface on the outer peripheral surface of the casing inlet 75*a*.

In the aspect described above, the present invention is applied to a direct tandem color printer. However, the present invention may also be applied to a black and white printer, a four-cycle color printer, or the like.

While the invention has been described in detail with reference to specific aspects thereof, it would be apparent to those skilled in the art that many modifications and variations may be made therein without departing from the spirit of the invention, the scope of which is defined by the attached claims.

What is claimed is:

1. An image-forming device comprising:

a main casing;

a process casing accommodated in the main casing and removably mounted thereon, the process casing having a casing inlet formed therein;

a photosensitive member that is disposed in the process casing;

a charger that is disposed in the process casing for charging a photosensitive member;

a first duct member that has a duct outlet;

a fan that blows air on the charger through the duct outlet of the first duct member and the casing inlet; and a duct moving unit that moves the first duct member between a first position in which the duct outlet of the first duct member is adjacent to the casing inlet formed in the process casing, and a second position in which the duct outlet is separated farther from the casing inlet than in the first position, wherein the duct moving unit further comprises an urging member that urges the first duct member in a direction to bring the duct outlet to be positioned near the casing inlet formed in the process casing.

2. The image-forming device according to claim 1, wherein the main casing has a door that is configured to open and close for allowing the process casing to be mounted on and removed from the main casing, and the duct moving unit switches the first duct member to the first position when the door is closed and to the second position when the door is opened.

3. The image-forming device according to claim 2, wherein the duct moving unit comprises an interlocking mechanism that operates in an interlocking relation the door.

4. The image-forming device according to claim 3, wherein the interlocking mechanism comprises a coupling member that is connected to the door, and a cam plate that is connected to the coupling member and that contacts the first duct member.

5. The image-forming device according to claim 1, further comprising an electric circuit board that supplies power to the charger; wherein the first duct member is interposed between the charger and the electric circuit board and is formed of a synthetic resin.

6. The image-forming device according to claim 5, wherein the electric circuit board is disposed in a plane substantially orthogonal to a direction in which the casing inlet opposes the duct outlet when the first duct member is in the first position.

7. The image-forming device according to claim 6, wherein the first duct member has one end portion and another end portion, the one end portion having the duct outlet, the another end portion having an air inlet through which air flow created by the fan passes, and the first duct member is pivotably moved about the another end portion.

8. The image-forming device according to claim 7, wherein the first duct member has a recessed part for preventing interference between the first duct member and the electric circuit board when the first duct member pivots.

9. The image-forming device according to claim 5, wherein the duct moving unit further comprises an urging member that urges the first duct member in a direction to bring the duct outlet to be positioned near the casing inlet formed in the process casing, and that is disposed inside the first duct member.

10. The image-forming device according to claim 1, further comprising a packing disposed in at least one of the duct outlet and the casing inlet to prevent air from leaking through a gap between the duct outlet and the casing inlet when the first duct member is in the first position.

11. The image-forming device according to claim 10, wherein the process casing has a surface near a peripheral edge of the casing inlet on the duct outlet side, and the packing is provided in the casing inlet and has an end face on the duct outlet side, the end face being positioned further inside the process casing than the surface of the process casing.

12. The image-forming device according to claim 10, wherein a process casing has a surface near a peripheral edge of the casing inlet on the duct outlet side, and the packing is provided in the casing inlet and has an end face of the packing on the duct outlet side, the end face being in flush with the surface of the process casing.

13. The image-forming device according to claim 1, further comprising a second duct member that is fixed to the main casing, wherein the first duct member has an air inlet in fluid communication with the second duct member, and the fan blows air into the first duct member through the air inlet from the second duct member.

14. The image-forming device according to claim 13, wherein the main casing comprises a duct part constituting at least a part of the second duct member.

15. The image-forming device according to claim 13, wherein the first duct member has one end portion and another end portion, the end portion having the duct outlet, the another end portion having the air inlet, and the first duct member is pivotably moved about the another end portion.

16. The image-forming device according to claim 1, wherein the first duct member has one end portion and another end portion, the end portion having the duct outlet, the another end portion having an air inlet through which air flow created by the fan passes, and the first duct member is pivotably moved about the another end portion.

17. The image-forming device according to claim 16, wherein the one end portion has a tapered surface that is sloped relative to a direction in which the duct outlet opposes the casing inlet when the first duct member is in the first position.

18. The image-forming device according to claim 17, further comprising a packing disposed in the casing inlet to prevent air from leaking through a gap between the duct outlet and the casing inlet when the first duct member is in the first position, wherein the taper surface contacts the packing when the first duct member is in the first position.

19. The image-forming device according to claim 1, further comprising a driving unit disposed on an opposite side of the process casing from the first duct member, the driving unit driving the photosensitive member.

* * * * *